US006184793B1

(12) United States Patent
Webb

(10) Patent No.: US 6,184,793 B1
(45) Date of Patent: Feb. 6, 2001

(54) METHOD OF TESTING ABOVEGROUND FUEL SYSTEMS

(75) Inventor: R. Michael Webb, Las Vegas, NV (US)

(73) Assignee: U-Fuel, Inc., Eau Claire, WI (US)

( * ) Notice: Under 35 U.S.C. 154(b), the term of this patent shall be extended for 0 days.

(21) Appl. No.: 09/385,290

(22) Filed: Aug. 30, 1999

(51) Int. Cl.[7] ..... G08B 21/00

(52) U.S. Cl. ..... 340/622; 340/584; 340/635; 73/40.5 R

(58) Field of Search ..... 340/622, 577, 340/584, 588, 618, 626, 635; 73/40.5 R

(56) References Cited

U.S. PATENT DOCUMENTS

| | | | | |
|---|---|---|---|---|
| 4,805,444 | * | 2/1989 | Webb | 73/40.5 R |
| 4,932,257 | * | 6/1990 | Webb | 73/40.5 R |
| 4,988,020 | | 1/1991 | Webb | 222/608 |
| 5,060,509 | * | 10/1991 | Webb | 73/40.5 R |
| 5,305,926 | | 4/1994 | Webb | 222/183 |
| 5,333,490 | * | 8/1994 | Webb | 73/40.5 R |
| 5,562,162 | | 10/1996 | Webb | 169/45 |
| 5,723,842 | | 3/1998 | Webb | 219/73 |
| 5,898,376 | | 4/1999 | Webb | 340/623 |

* cited by examiner

*Primary Examiner*—Edward Lefkowitz
(74) *Attorney, Agent, or Firm*—Knoble & Yoshida, LLC

(57) ABSTRACT

A method of testing an aboveground-type fuel storage tank includes steps of positioning at a test location an aboveground-type fuel storage tank that has been configured as it is intended to be in commercial use and at least partially filling the aboveground-type fuel storage tank with a fuel that is intended to be stored in the storage tank during commercial use. The exterior of the aboveground-type fuel storage tank is then subjected to a petroleum-fed fire for a period of time that is preferably at least one hour at a temperature of about 2000 degrees F. The integrity of the aboveground-type fuel storage tank is then checked to determine the effect of the fire on the aboveground-type fuel storage tank.

19 Claims, 5 Drawing Sheets

METHOD OF TESTING ABOVEGROUND FUEL SYSTEMS

BACKGROUND OF THE INVENTION

1. Field of the Invention

This invention relates to aboveground fuel and fueling systems, such as those that are manufactured by U-Fuel, Inc. of Eau Claire, Wis. Specifically, the invention pertains to processes and systems for testing aboveground fuel and fueling systems for resistance against fire-related emergencies.

2. Description of the Related Technology

Nearly all modern airports and marinas have facilities of some type for refueling. The most prevalent type of aircraft refueling facility includes a belowground storage tank and an aboveground pumping module that is operated by an attendant, much in the manner of commercial service stations for automobiles.

One significant disadvantage of such in-ground refueling stations is the time and labor involved in preparing for and constructing such a facility. Some factors which contribute to the expense of constructing a belowground facility include the need for construction permits, subcontractors, excavation and the time and planning involved in locating a permanent site for the facility. Once installed, such facilities can not practically be moved to different locations at the airport, to other airports, or be sold.

In recent years, some aboveground refueling facilities have become commercially available. This development in the field has been pioneered by U-Fuel, Inc. of Eau Claire, Wis. Examples of the new aboveground technology include the systems that are described in the following U.S. Patents:

| | |
|---|---|
| 5,898,376 | Modular overfill alarm assembly for vented storage tanks |
| 5,723,842 | Above-ground fire-resistant storage tank system and fabrication method |
| 5,562,162 | Portable fueling facility |
| 5,305,926 | Portable fueling facility having fire-retardant material |
| 4,988,020 | Portable fueling facility |

Another concern that is often expressed by regulatory authorities and the owners of aboveground fuel storage facilities is the possibility of catastrophic fire or explosion if surrounding objects catch on fire. One standard that has been promulgated for such units holds that risk is sufficiently minimized when a tank can withstand a 2000.degree. F. environment for two hours. This standard is codified in Underwriters Laboratories test procedure 2085.

Unfortunately, it is difficult to perform a test as rigorous as that set forth above on an aboveground fueling system that simulates real world conditions. Because of the enormous combustion power of fuels such as propane, gasoline and jet fuel in quantities that would be sufficient to fill a typical aboveground fuel storage unit, the prevalent attitude in the industry prior to this invention was that it is too dangerous to subject such a unit when filled with fuel to a test fire under any circumstances. Instead, testing of such equipment has been done on empty tanks, or prototypes in ovens or open fires.

In addition, the previous testing methods were felt inadequate by some because they failed to take into account such factors as wind, which during a fire can cause sharp temperature gradients on the tank surface, thereby generating uneven strain that could potentially result in a breach in the tank.

It is clear there has existed a long and unfilled need in the prior art for a process for testing aboveground fuel tanks and fueling systems for their ability to withstand fire-related emergencies that more accurately simulates conditions of a likely fire-related emergency than tests that have heretofore been practiced and proposed.

SUMMARY OF THE INVENTION

Accordingly, it is an object of the invention to provide a process for testing aboveground fuel tanks and fueling systems for their ability to withstand fire-related emergencies that more accurately simulates conditions of realistic fire-related emergencies than tests that have heretofore been practiced and proposed.

In order to achieve the above and other aspects of the invention, a method of testing an aboveground-type fuel storage tank according to one aspect of the invention includes steps of (a) positioning at a test location an aboveground-type fuel storage tank that has been configured as it is intended to be in commercial use; (b) at least partially filling the aboveground-type fuel storage tank with a fuel that is intended to be stored in the storage tank during commercial use; (c) subjecting the exterior of the aboveground-type fuel storage tank to a petroleum-fed fire for a period of time of at least fifteen minutes; and (d) checking the integrity of the aboveground-type fuel storage tank to determine the effect of the fire on the aboveground-type fuel storage tank.

A method of monitoring an aboveground type fuel storage tank while testing the tank for its fire resistance characteristics includes, according to a second aspect of the invention, steps of determining the integrity of the tank; at least partially filling the tank with a fuel; and subjecting the exterior of the tank to heat that simulates a real-world petroleum fire without causing the fuel in the tank to explode.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
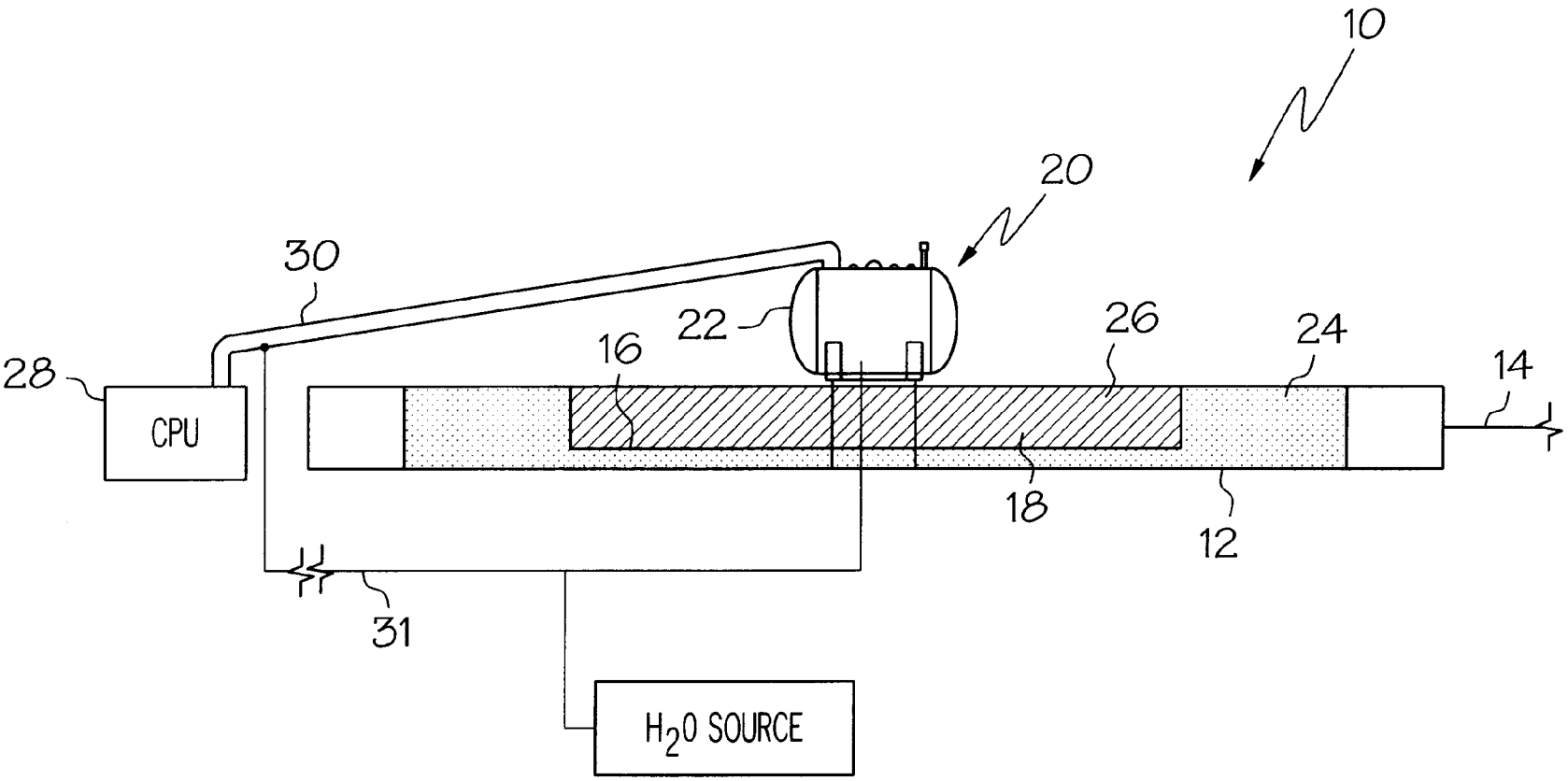
FIG. 1 is a schematic depiction of a system and process for testing an aboveground fuel system according to a preferred embodiment of the invention.

Referring now to the drawings, wherein like reference numerals designate corresponding structure throughout the views, and referring in particular to FIG. 1, a test location 10 for a method of testing an aboveground fueling tank according to a preferred embodiment of the invention includes a first compartment 12 that is positioned above the surrounding ground 14. The location of the ground or area 14 is outdoors, preferably isolated, a well exposed to complicating conditions, such as wind. A second, smaller compartment 16 is positioned within the first compartment 12, as is shown in FIG. 1. Test location 10 further includes a fixture 18 that is constructed and arranged to support an aboveground fueling tank 20 at an elevated position to ensure wide exposure of the outer surface of the tank to the flames during the test. As may be seen in FIG. 1, fixture 18 is water-cooled and is connected to a source of coolant water via a conduit 31.

Tank 20 in the embodiment of FIG. 1 includes a pressurized tank 22 of the type that is used to hold a liquefied gas such as liquid propane. As is depicted schematically in FIG. 1, the first compartment 12 is designed to hold a thermally insulating liquid, preferably water 12, while the second compartment 16 is designed to hold a flammable petroleum based material, which in the preferred embodiment is liquid diesel fuel 26.

As may further be seen FIG. 1, the test location 10 includes an analysis center 28 that is located remotely from the rest of the test location 10, but that is electronically connected to the test location 10, preferably by means of a protected conduit 30.

Figure 3:
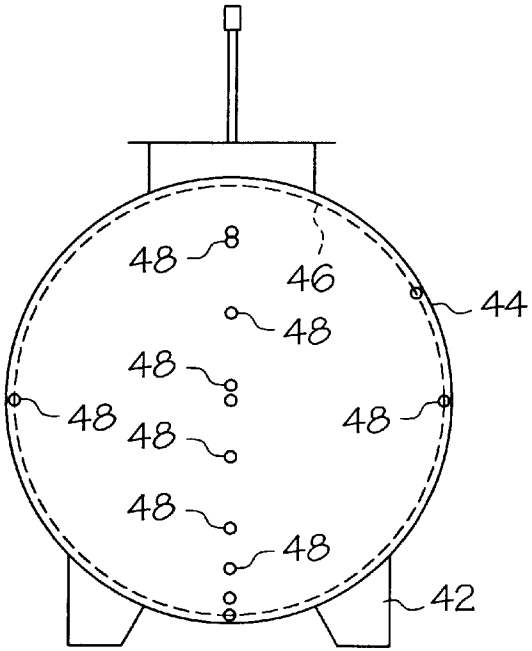
FIG. 3 is an end view of the tank that is depicted in FIG. 2.
Figure 2:
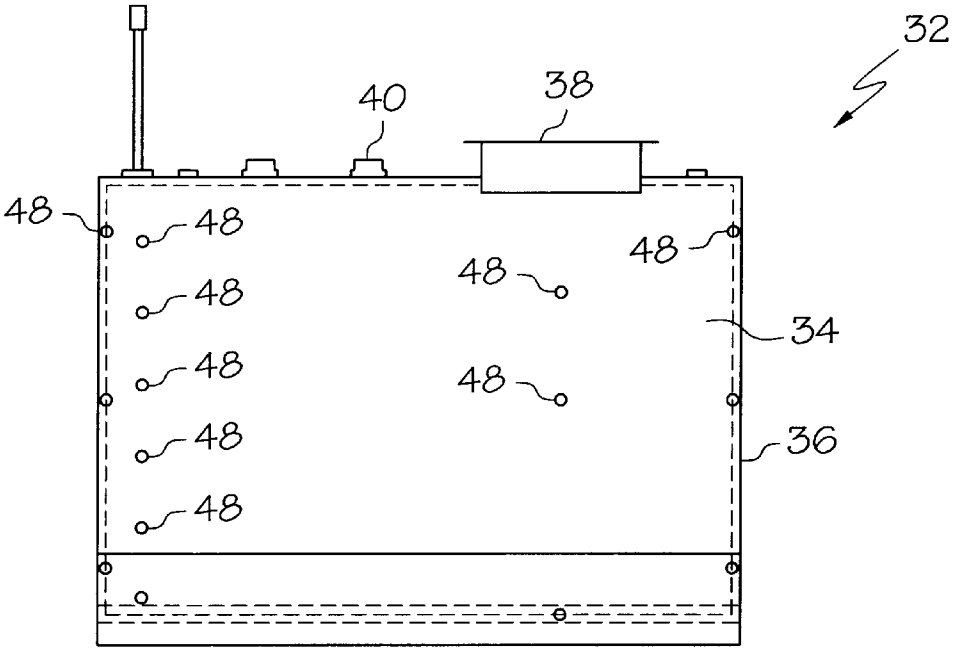
FIG. 2 is a side elevational view of one type of tank that can be tested according to the invention.

Looking now to FIGS. 2 and 3, a fuel storage tank 32 of the type that is used to store flammable liquids, such as gasoline or jet fuel, may also be effectively tested according to the invention. As may be seen in FIG. 2, aboveground fuel storage tank 32 includes a cylindrical body 34 and a pair of end walls 36. As is common in these types of units, a manway 38 is provided at the top of the tank 32 for gaining access to the interior of the tank 32, and an emergency vent 40 is also provided that the top of tank 32, for purposes that will be described in greater detail below. As may best be seen in FIG. 3, fuel tank 32 is supported with respect to the underlying surface, which may be the ground or the fixture at 18 that is shown in FIG. 1, by a plurality of saddle members 42. Tank 32 has an outer surface 44, and an inner surface 46 that is defined by walls 34, 36 and defines an interior space that is used to store the liquid fuel.

Figure 5:
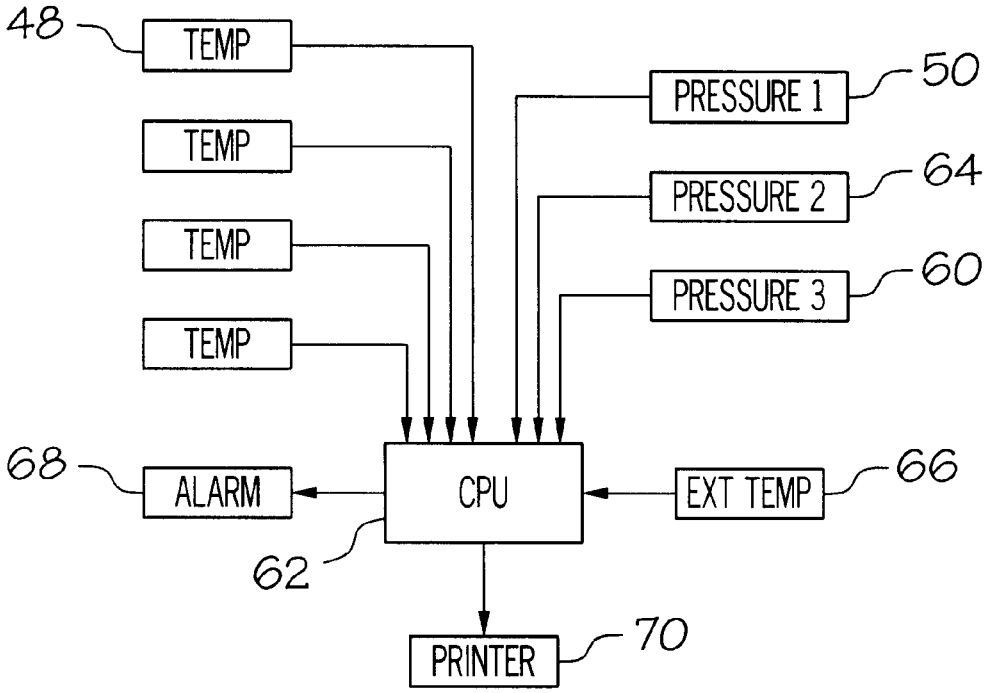
FIG. 5 is a schematic diagram depicting a control system according to the preferred embodiment of the invention.

Referring now briefly to FIGS. 2, 3 and 5, it will be seen that a plurality of temperature sensors 48, which in the preferred embodiment arc thermocouples, are positioned at pre-selected locations on the inner surface 46 of the aboveground fuel tank 32. The locations are carefully pre-selected to measure such information as longitudinal and circumferential temperature differentials, and thus potential for expansion and strain, and may also be used to monitor the level of liquid fuel in the tank 32 during the test. In addition, as is illustrated schematically in FIG. 5, a first pressure sensor 50 is in communication with a CPU 62 that forms the computing core of the analysis center 28 that is depicted in FIG. 1. The purpose of first pressure sensor 50 will be described in greater detail below. A second pressure sensor 64 and third pressure sensor 60 are likewise in communication with the CPU 62. At least one external temperature sensor 66 for measuring temperature conditions externally of the tank 32 is further provided, and is in communication with the CPU 62. As is shown in FIG. 5, an alarm 68 may be in communication with the CPU 62 for providing notice to technicians and other bystanders should conditions in the fuel tank 32 become dangerous in the course of testing. A printer 70 for printing the results of the test may also be provided.

Figure 4A:
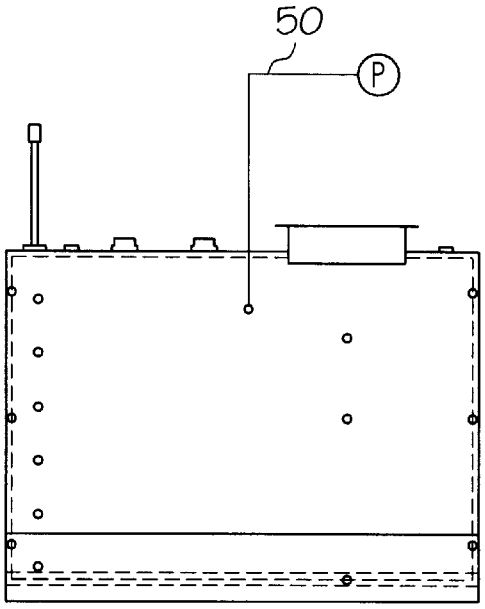
FIGS. 4A through 4D are diagrammatical depictions of different steps that may be performed in a method according to the preferred embodiment of the invention.

Describing now the preferred method for testing a fuel system for its fire resistance characteristics, an aboveground-type fuel storage tank that has been configured as it is intended to be in commercial use (in the case of an aboveground fuel storage and dispensing system this may include the fueling pumps and electronics as well) is preferably first given a pressure check prior to testing to make certain that the tank is not defective and that there are leaks. This process is schematically depicted in FIG. 4A. The aboveground-type fuel storage tank is then positioned at the test location 10 in the manner that is shown in FIG. 1. The temperature and pressure sensors are connected, and any wires leading therefrom are encased in an insulated, protected conduit jacket that is water-cooled and connected to the source of coolant via the conduit 31.

The aboveground-type fuel storage tank is then at least partially filled with a fuel, such as propane, gasoline or jet fuel, that is intended to be stored in the storage tank during commercial use. As may be seen in FIG. 4B, the tank is filled to a fuel level 52.

Figure 4B:
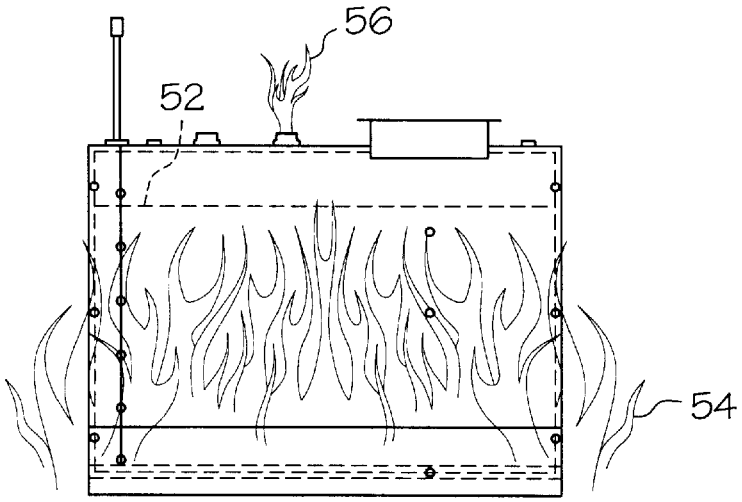
Figure 4C:
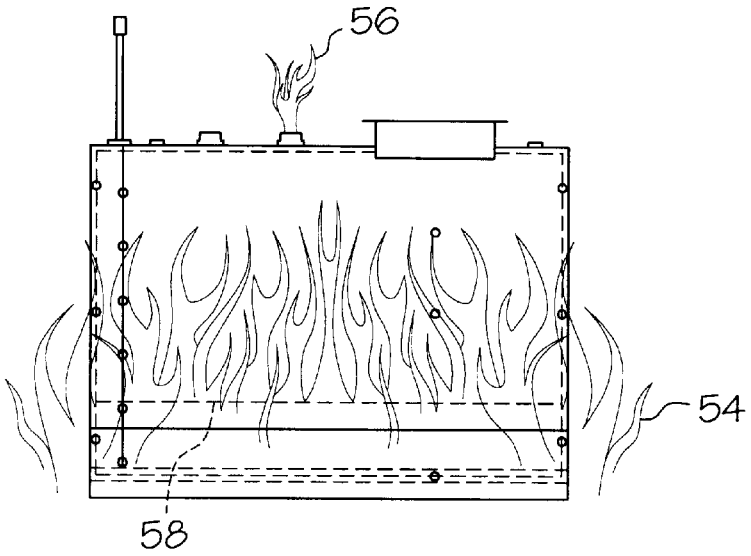
Figure 4D:
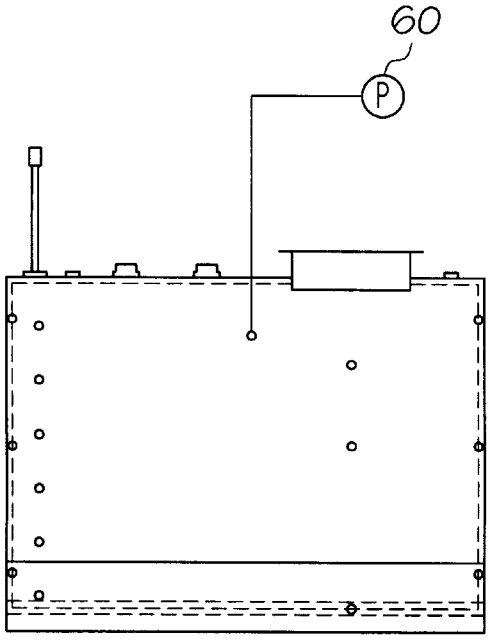

At this point, flammable petroleum-based material is introduced into the second compartment 16, and the fuel is ignited. The entire exterior of the aboveground-type fuel storage tank is exposed to a petroleum-fed fire 54 for a period of time that is at least fifteen minutes, but that could be at least thirty minutes and is most preferably at least one hour. The temperature of the fire is at least 1000 degrees F and is most preferably 2000 degrees F or more. The fuel within the tank will beat under this intense input of thermal energy, and, in the case of a liquid fuel such as gasoline or jet fuel, lighter components of the fuel will evaporate and be forced as a gas out of the emergency vent 40, where it will ignite as a burn-off flame 52, as shown in FIG. 4B. As time goes on, this will result in a consumption of the fuel within the tank, thereby changing the fuel/air mixture within the tank. Accordingly, the test permits testing of the tank under almost all fill conditions that are likely to be encountered in the event of an actual emergency.

During the test, the temperature conditions and pressure within the tank are constantly monitored. Through strategic placement of temperature sensors, local thermal expansion and resulting stress within the tank may be measured and charted.

After the petroleum-based fire is extinguished the integrity of the aboveground-type fuel storage tank is checked to determine the effect of the fire on the aboveground-type fuel storage tank. This will include a visual inspection of the tank, and also preferably includes a pressure integrity test that is monitored by the pressure sensor 60. In addition, a hose stream test is preferably conducted that includes a process of directing a stream of high-pressure water against the outside of the tank. This simulates conditions that would occur in the event of an actual emergency, where firefighters might attempt to use a fire hose. It is essential that the tank be able to withstand such a test without being breached. A breached would allow oxygen to enter the tank, possible causing an explosion.

EXAMPLE

Summary: Tests were performed in accordance with the pool fire exposure conditions described in Title 10 CFR 71.73 (c), (4), which simulate a "worst case" hypothetical accident condition subjecting the tanks to a completely engulfing liquid hydrocarbon pool fire. The fire exposure conditions had a minimum emissivity of 0.9 and the average flame temperature is in excess of 1475 degrees F for the duration of the exposure. The tanks were filled to near capacity with gasoline fuel and propane and subjected to complete engulfment in the pool fire for more than 60 min. The emergency venting equipment performed as intended and the AST (Aboveground Storage Tank) and LPG (Liquid Petroleum Gas) tank maintained their integrity and did not allow liquid leaks to occur during the 60-min fire exposure. The AST passed the post-fire 5 psi pneumatic test and the LPG passed the post fire 250 psi hydrostatic test.

Details: The AST and LPG tank were first subjected to a pre-fire pneumatic leakage test at 5 psi for a minimum period of one-hour to insure the tanks were airtight before the pool fire test. Having observed no leaks, the AST was outfitted with thermocouples (TC's) on the interior surface of the primary tank. Thermocouples were also placed within the tank to measure the temperature of the fuel or air space and monitor the evaporation rate. The LPG tank was fitted with a pressure transducer to monitor the internal temperature and pressure during the test.

Following the pool fire exposure and a hose stream test, the openings (fittings) in the AST were capped and the tank was subjected to a post-fire pneumatic leakage test at 5 psi for a minimum period of one-hour to insure that the tank remained airtight after the pool fire test.

Following the fire exposure test, the openings (fittings) in the LPG tank were capped and the tank was subjected to a post-fire hydrodynamic test at 250 psi for a minimum period of 15 mm to insure that the tank remained leak tight after the pool fire test.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of testing an aboveground-type fuel storage tank, comprising steps of:

(a) positioning at a test location an aboveground-type fuel storage tank that has been configured as it is intended to be in commercial use;

(b) at least partially filling the aboveground-type fuel storage tank with a fuel that is intended to be stored in the storage tank during commercial use;

(c) subjecting the exterior of the aboveground-type fuel storage tank to a petroleum-fed fire for a period of time that is at least fifteen minutes; and (d) checking the integrity of the aboveground-type fuel storage tank to determine the effect of the fire on the aboveground-type fuel storage tank.

2. A method according to claim 1, wherein step (a) is performed at an outdoor location, whereby the effects of exposure such as wind acting in conjunction with the fire may be determined on the aboveground-type fuel storage tank.

3. A method according to claim 1, wherein step (c) comprises modifying a ratio of fuel to air within the aboveground-type fuel storage tank during exposure to the petroleum-fed fire.

4. A method according to claim 3, wherein the aboveground-type fuel storage tank includes an emergency burn-off vent, and wherein the modification of the fuel to air ratio comprises burning off fuel vapors from the emergency vent during exposure to the petroleum-fed fire.

5. A method according to claim 1, wherein step (c) is performed by subjecting the exterior of the aboveground-type fuel storage tank to a petroleum-fed fire for a period of time that is at least thirty minutes.

6. A method according to claim 5, wherein step (c) is performed by subjecting the exterior of the aboveground-type fuel storage tank to a petroleum-fed fire for a period of time that is at least one hour.

7. A method according to claim 1, further comprising a step of monitoring temperature at a plurality of selected locations on the aboveground-type fuel storage tank during step (c).

8. A method according to claim 7, wherein the step of monitoring temperature at a plurality of selected locations on the aboveground-type fuel storage tank comprises monitoring a plurality of location on an inside surface of the aboveground-type fuel storage tank.

9. A method according to claim 1, further comprising a step of monitoring temperature of the fuel within the fuel storage tank during step (c).

10. A method according to claim 1, further comprising a step of monitoring pressure within the fuel storage tank during step (c).

11. A method according to claim 1, further comprising a step of pressurizing the aboveground-type fuel storage tank prior to step (c) in order to preliminarily assess the integrity of the aboveground-type fuel storage tank.

12. A method according to claim 1, wherein the aboveground-type fuel storage tank is of the type that is configured to store a pressurized fuel.

13. A method according to claim 1, wherein step (d) comprises visually inspecting the aboveground-type fuel storage tank.

14. A method according to claim 1, wherein step (d) comprises pressurizing the aboveground-type fuel storage tank to test its structural integrity.

15. A method according to claim 1, wherein step (c) is performed by igniting a pool of petroleum-based material that is positioned beneath the aboveground-type fuel storage tank.

16. A method according to claim 15, wherein the pool of petroleum-based material comprises diesel fuel.

17. A method according to claim 15, further comprising thermally isolating the pool of petroleum-based material that is positioned beneath the aboveground-type fuel storage tank from the surrounding ground.

18. A method of monitoring an aboveground type fuel storage tank while testing the tank for its fire resistance characteristics, comprising:

(a) determining the integrity of the tank;

(b) at least partially filling the tank with a fuel; and (c) subjecting the exterior of the tank to heat that simulates a real-world petroleum fire, and wherein step (c) is performed without causing the fuel in the tank to explode.

19. A method according to claim 18, wherein step (c) is performed while the tank is resting on a support, and further comprising a step of actively cooling the support during step (c) to prevent collapse of the support due to the heat of the fire.

* * * * *